United States Patent [19]

Lawless et al.

[11] Patent Number: 4,515,534

[45] Date of Patent: May 7, 1985

[54] MINIATURE SOLID-STATE GAS COMPRESSOR

[76] Inventors: William N. Lawless, 518 Illinois Ct., Westerville, Ohio 43081; Leslie E. Cross, 401 Glenn Rd., State College, Pa. 16801; William A. Steyert, c/o Oakhurst Dr., R.D. 1, Box 99, Center Valley, Pa. 18034

[21] Appl. No.: 431,447

[22] Filed: Sep. 30, 1982

[51] Int. Cl.[3] ..... F04B 35/04; F04B 45/08

[52] U.S. Cl. ..... 417/322; 417/412; 417/474; 417/478

[58] Field of Search ..... 417/322, 412, 413, 474, 417/478

[56] References Cited

U.S. PATENT DOCUMENTS

| | | | |
|---|---|---|---|
| 3,107,630 | 10/1963 | Johnson et al. | 417/322 |
| 3,264,998 | 8/1966 | Dingman | 417/474 |
| 3,963,380 | 6/1976 | Thomas et al. | 417/322 |

FOREIGN PATENT DOCUMENTS

| | | | |
|---|---|---|---|
| 56-9679 | 1/1981 | Japan | 417/322 |
| 565115 | 8/1977 | U.S.S.R. | 417/322 |
| 806897 | 3/1981 | U.S.S.R. | 417/322 |

OTHER PUBLICATIONS

Barron, Randal, Cryogenic Systems (McGraw-Hill) 1966, pp. 301-331.

NBS Special Publication 508, pp. 75-80.

*Primary Examiner*—Richard E. Gluck

*Attorney, Agent, or Firm*—Biebel, French & Nauman

[57] ABSTRACT

A miniature apparatus for compressing gases is disclosed in which an elastomer disposed between two opposing electrostrictive or piezoelectric ceramic blocks, or between a single electrostrictive or piezoelectric ceramic block and a rigid surface, is caused to extrude into or recede from a channel defined adjacent to the elastomer in response to application or removal of an electric field from the blocks. Individual cells of blocks and elastomer are connected to effect a gas compression by peristaltic activation of the individual cells. The apparatus is self-valving in that the first and last cells operate as inlet and outlet valves, respectively. Preferred electrostrictive and piezoelectric ceramic materials are disclosed, and an alternative, non-peristaltic embodiment of the apparatus is described.

16 Claims, 9 Drawing Figures

MINIATURE SOLID-STATE GAS COMPRESSOR

The United States government has rights in this invention pursuant to Contract No. W-7405-ENG-36 between the U.S. Department of Energy and the University of California.

BACKGROUND OF THE INVENTION

The present invention relates to a gas compressor and, more particularly, to such a device capable of miniaturization and requiring relatively low electrical power input.

Within the past decade, a variety of new super-conducting cryoelectronic devices have been developed based upon the Josephson effect. These devices include, for example, extremely sensitive magnetometers, gradiometers, bolometers, voltage standards, current comparators, rf attenuators and logic elements. See, e.g., IEEE Trans. On Magnetics, Vol. 17, No. 1, Jan., 1981, Sessions BC, CC, SC, HC, IC. These devices typically operate at temperatures below about 22° K. (i.e., 22 degrees absolute), and the power dissipated by such devices is characteristically on the order of microwatts.

Several methods are available for obtaining the cryogenic temperatures required for these devices. The simplest approach is to use liquid helium, but this method requires elaborate Dewars, is expensive and cumbersome, and requires an available supply of liquid helium. More convenient methods include the use of closed-cycle mechanical refrigerators, which are generally well-known in the art. The two most familiar of these refrigerators are the Gifford-McMahon (modified Stirling) cycle, and the Joule-Thompson expansion cycle, discussed, for example, in Barron, *Cryogenic Systems* (McGraw-Hill, Inc., 1966). A typical Gifford-McMahon refrigerator has two stages, operates at 200 psig., and delivers approximately one watt of useful refrigeration at about 10 to 15° K. A Joule-Thompson expansion cycle is commonly staged onto a Gifford-McMahon refrigerator, utilizes a 300 to ½ psig expansion, and delivers approximately three watts of useful refrigeration at 4.2° K.

It will be recognized from the above that there is a great mismatch between the refrigeration requirements of the cryoelectronic devices, typically on the order of microwatts, and the refrigeration capacity of known mechanical refrigerators, typically on the order of watts.

A recent approach to matching these power considerations involves the microminiaturization of refrigeration systems using planar photoresist technology similar to that used in the semi-conductor industry. See e.g., NBS Special Publication 508, 75–80 (U.S. Dept. of Commerce, April, 1978). Although the Stirling, Gifford-McMahon, and Joule-Thompson systems all lend themselves to microminiaturization, the Joule-Thompson system appears most practical due to the absence of moving parts. Prototypes for such systems have been discussed in the prior art, designed to deliver about 20 milliwatts of useful refrigeration below 20° K.

These micro-refrigerators, while bringing the device-refrigerator power considerations into commensuration, have yet to overcome a major practicality hurdle. In particular, a compressor suitable for driving such a refrigerator for a extended period of time is not presently known.

Suggested compressors have typically involved small gas cylinders or adsorption-desorption pumps. Gas cylinders, of course, have only limited lifetimes. Adsorption-desorption pumps operate on the principle that certain solids, such as zeolites or metal hydrides, selectively adsorb certain gases at a first temperature and pressure, and desorb them at a second, higher temperature and pressure. Therefore, by thermally cycling such a solid with appropriate valving, gas compression is achieved. These pumps are disadvantageous in that long cycle times are involved, typically on the order of 30 minutes, due to slow adsorption and heat-transfer rates. Further, the overall compression efficiency of such pumps is low.

What is needed, therefore, is a gas compressor ideally matched to the requirements of the micro-refrigerators described above. Such a compressor should be of small size, commensurate with the small size of the microminiature refrigerators. Further, the compressor should have relatively modest electric power requirements, and should be capable of supplying sufficiently large gas flow rates. Moreover, the compressor should be applicable to any gas.

SUMMARY OF THE INVENTION

The present invention discloses a solid-state, room-temperature gas compressor deriving its compression action from the relatively large dimensional changes that occur in certain electrostrictive and high strain capability piezoelectric ceramic materials when an electric field is appropriately applied. While the present invention will be described in terms of electrostrictive ceramic materials, it will be understood that reference to electrostrictive materials in this specification will include high strain capability ceramic materials. The apparatus includes a block of such ceramic material, and an elastomer disposed along one end of the block. The apparatus further includes a means for defining a channel, wherein the elastomer forms at least one wall thereof, and a means for selectively applying an electric field to the ceramic block. The block is constrained such that application of the electric field to the block causes its displacement against the elastomer. This displacement extrudes the elastomer into a closing relationship with the channel.

The apparatus may include a pair of blocks of a ceramic material, disposed in an opposing relationship so as to form a gap therebetween. The elastomer is disposed within and at least partially fills the gap. The blocks are constrained such that application of the electric field causes the displacement of the blocks against the elastomer.

The electrostrictive ceramic material may be $PbMO_3$, where M is a member selected from the group consisting of Zr, Ti, $(Mg_{\frac{1}{3}}N_{\frac{2}{3}})$, and $(Sc_{\frac{1}{3}}Ta_{\frac{2}{3}})$, or appropriate combination thereof. Alternatively, the material may be a high strain capability piezoelectric ceramic material. Suitable piezoelectric materials include so-called donor-doped soft piezoelectric ceramics from the lead zirconate and lead titanate families. These soft piezoelectric materials have low coercivity and high d33 coefficients. Examples are PZT-5A and PZT-5H piezoelectric ceramics available from Vernitron Corp.

The apparatus may further include an inlet valve means for selectively introducing the quantity of gas to the channel, and an outlet valve means for selectively allowing the gas to exit the channel. Additionally, the means for applying the electric field may include a plurality of metallic plates disposed in a substantially parallel, spaced relationship within each of the ceramic blocks.

The apparatus may include a plurality of cells, where each cell includes a pair of ceramic blocks defining a gap therebetween, an elastomer disposed within the gap, means defining a channel having the elastomer as at least one wall thereof, and means for applying an electric field to the blocks, wherein the blocks are constrained such that application of the field causes displacement against the elastomer, extruding it into a closing relationship with the channel. The cells are arranged sequentially, such that each channel of each cell communicates with the channel of the immediately preceeding and succeeding cells. A means for selectively controlling the electric field application means of each of the cells is provided for sequential closings of each of the channels. The sequential closings operate to peristaltically compress a gas introduced into the channels.

An additional cell may be provided adjacent the first of the sequential cells, for operation as an inlet valve. Similarly, a cell may be provided adjacent the last of the sequential cells, for operation as an outlet valve. The means for electric field control is further adapted to control selectively the electric field application means of the inlet valve cell and the outlet valve cell. The apparatus may further have the volume defined by each channel of each sequential cell smaller than the volume defined by the channel of the immediately preceding cell.

One method for compressing the gas includes the steps of providing a plurality of channels connected together in sequence, where each channel has at least one wall of an elastomeric material, and the channels cooperate to define a continuous passage having a first and a second end. A quantity of gas is introduced into the passageway, and the passageway is closed at the first and second ends. Each of the elastomeric walls is extruded into each of the channels, so as to close the channel. The extruding is performed sequentially from the channel adjacent the first end up to but not including the channel adjacent the second end. Thus, the gas within the passageway is compressed into the channel adjacent to the second end.

Accordingly, it is an object of the present invention to provide an apparatus for compressing a gas having a block of an electrostrictive or piezoelectric ceramic material, an elastomer, a channel, and a means for applying an electric field to the block, whereby the block displaces and extrudes the elastomer so as to close the channel; to provide a gas compressor wherein the compression effect is derived from the peristaltic activation of several cells, wherein each cell utilizes the extrusion of an elastomer into a channel defined within that cell such that the overall effect is to compress the gas into the final cell; to provide such an apparatus that is more efficient than conventional mechanical compressors and is suitable for miniaturization; to provide such an apparatus which is self-valving and self-lubricating and thereby free of the chronic contamination problems associated with conventional compressor seals and valves; and to provide such an apparatus wherein the gas compression is performed relatively isothermally.

Other objects and advantages of the invention will be apparent from the following description, the accompanying drawings and the appended claims.

DETAILED DESCRIPTION OF THE PREFERRED EMBODIMENT

Figure 1:
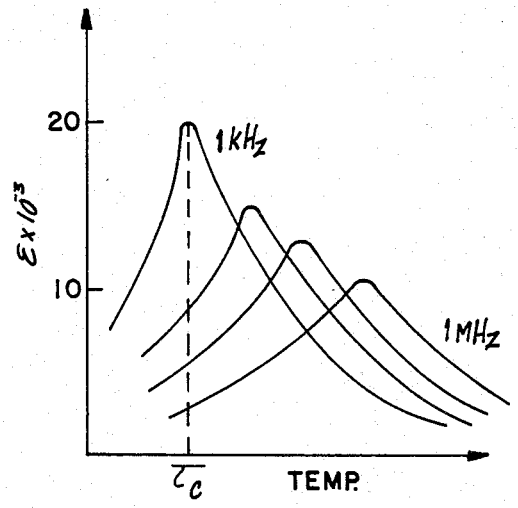
FIG. 1 is a typical plot of the dielectric permittivity of the material $PbMg_{\frac{1}{3}}Nb_{\frac{2}{3}}O_3$, permittivity shown as a function of temperature at several operating frequencies.

The gas compressor of the present invention utilizes the electrostrictive or piezoelectric properties of several potential ceramic materials. Electrostrictive materials display relatively large induced strains, $\delta/L$, under the action of an applied electric field E. Here, $\delta$ is the incremental change of the dimension L, according to which $$(\delta/L)_i = Q_{ij}P_j 2 \quad (1)$$

where $Q_{ij}$ is the electrostrictive coefficient and $P_j$ is the polarization introduced by the field $E_j$. The subscripts i and j in Eq. (1) reflect the fact that the electrostrictive effect occurs three-dimensionally throughout the solid. Thus, $$(\delta/L)_{perp} = Q_{12}P^2 \quad (2)$$

$$(\delta/L)_{para} = Q_{11}P^2 \quad (3)$$

where $(\delta/L)_{perp}$ and $(\delta/L)_{para}$ are the strains induced perpendicular and parallel to the polarization, respectively.

The polarization is related to the electric field by $$P = \epsilon_o\epsilon(E)E \quad (4)$$

where $\epsilon_o$ and $\epsilon$ are the dielectric permittivities of free space and of the electrostrictive material, respectively, and $\epsilon$ is E-field dependant. Therefore, for an isotropic ceramic body as used in the present invention, $$(\delta/L)_{perp} = \epsilon_o^2 2\epsilon^2(E)Q_{12}E^2 \quad (5)$$

$$(\delta/L)_{para} = \epsilon_o^2\epsilon^2(E)Q_{11}E^2 \quad (6)$$

Preferably, the electrostrictive ceramic materials used in the present invention are $PbZrO_3$, $PbTiO_3$, $PbMg_{\frac{1}{3}}Nb_{\frac{2}{3}}O_3$, or $PbSc_{\frac{1}{3}}Ta_{\frac{2}{3}}O_3$ or appropriate combinations thereof. Referring now to the drawings, and in particular FIG. 1, a permittivity-temperature plot typical of the most preferred of these materials, $PbMg_{\frac{1}{3}}Nb_{\frac{2}{3}}O_3$, is presented showing the frequency dependance of the permittivity. At relatively low operating frequencies, on the order of one kilohertz, $\epsilon$ achieves very large values, on the order of 20,000, as shown in FIG. 1. Thus, while the electrostrictive coefficient $Q_{ij}$, may be relatively modest, the strains are, in fact, very large because of the multiplying $\epsilon^2$ factor, as shown in Eqs. (5) and (6). As a result, these materials achieve strains in the range $4\times10^{-4}$ to $10^{-3}$ at kHz frequencies in the neighborhood of the transition temperature $T_c$ for E-field strengths of approximately 20 kV/cm. Moreover, as is well-known in the ceramic art, the transition temperature $T_c$ can be widely adjusted by using appropriate solid solutions of the ceramic materials set out above, including adjusting $T_c$ to 25° C.

It will be recognized, of course, that although these lead-containing ceramics are particularly suited for the gas compressor of the present invention and constitute the preferred materials, the compressor may be constructed using other suitable electrostrictive materials or piezoelectric ceramics having high strain capability.

Figure 2:
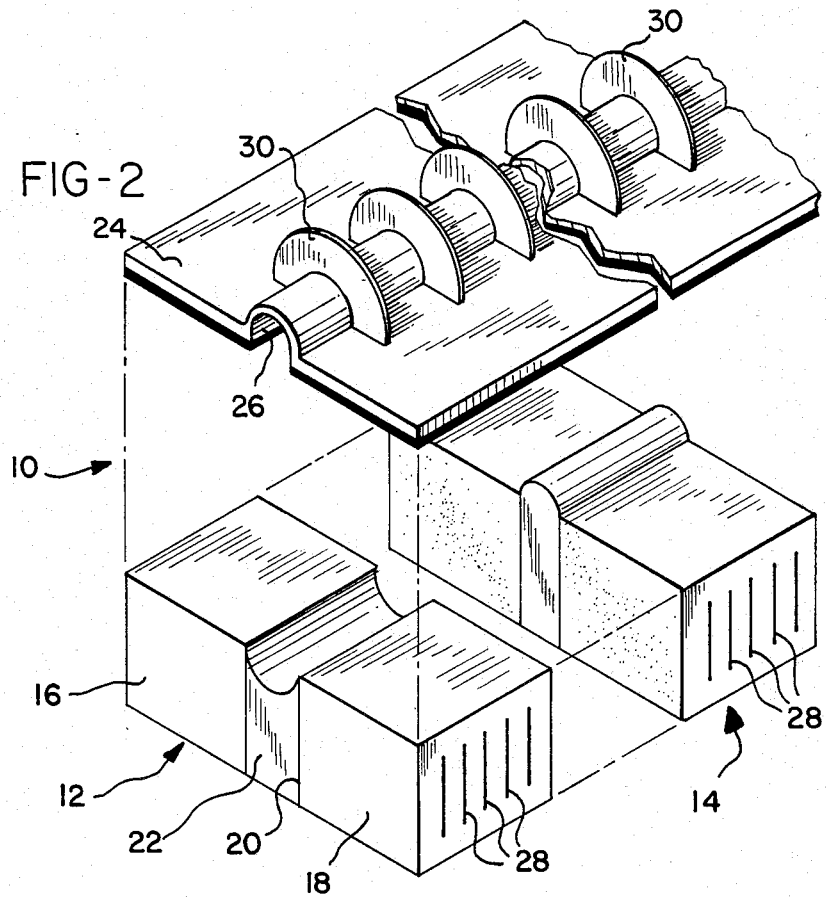
FIG. 2 is a perspective schematic view showing two adjacent cells of a gas compressor according to the present invention with the elastomeric motion and channel height exaggerated for purposes of clarity.

The large electrostrictive (or piezoelectric) strains obtainable with these materials are used to obtain a peristaltic pumping action for gas compression, as illustrated in FIG. 2. The gas compressor 10 is composed of a plurality of cells, or sections, two of which are shown in the exploded view of FIG. 2, indicated at 12 and 14.

Each of the cells of the compressor 10, for example cell 12, includes a pair of blocks of the ceramic material 16 and 18. The blocks 16 and 18 are mounted in a spaced relationship such that they define a gap 20 between their opposing faces. Gap 20 is filled with an elastomer material 22, which may preferably be Dow Corning Silastic TR-55. A covering plate 24 is mounted to the top of blocks 16 and 18. An inverted channel 26 is defined lengthwise along cover plate 24, such that it communicates with gap 20 formed between blocks 16 and 18.

An electric field is selectively applied to the two opposing ceramic blocks 16 and 18. The blocks are constrained by an appropriate frame (not shown) such that the motion of the blocks is directed against the elastomer 22 filling gap 20. The elastomer 22 is electrostrictively "pinched", which in turn causes the elastomer to be extruded out of the gap 22 and into the channel 26 defined in covering plate 24.

It can be seen in FIG. 2 by comparing the respective portions of elastomer 22, that the blocks of cell 14 have an electric field applied thereto, while the blocks 16 and 18 of cell 12 have no field applied. The pumping action of the gas compressor 10 derives from forcing the gas out of the channel section of cell 14 into the channel section of cell 12 by applying an electric field to cell 14, thereby closing its respective channel. By arranging several of these cells such that the channels define a common passageway and by sequentially applying electric fields to each cell, a peristaltic gas compression effect may be realized.

The preferred means for applying electric fields to the ceramic blocks is by metallic plate electrodes 28 interspersed within each ceramic block. Multilayering of plate electrodes is well-known in the art for the manufacture of ceramic capacitors, and the blocks with interspersed electrodes may be preferably constructed by known "tape-casting" methods. Using such a method, the plate electrodes are typically separated by ceramic material of approximately $2\times10^{-3}$ to $10^{-2}$ cm thickness. Consequently, the voltage supply for a gas compressor according to the preferred embodiment would be on the order of 40 to 200 volts.

It can be seen from FIG. 2 that the $Q_{12}$ coefficient of Eq. (5) is involved because the electrostrictive displacement of the blocks is perpendicular to the electric-field direction. It will be recognized that each block in fact includes two alternating sets of plate electrodes, with one set for voltage and the other for ground. All ground electrodes in all cells may be wired in common, thereby facilitating the switching of the application of the electric field from cell to cell. Each cell of the gas compressor 10 must be bonded together to avoid gas loss along the cell interfaces, and the elastomer used to fill gap 20 may be used for this bonding as well. An elastomeric bonding between the cells allows one cell to elongate electrostrictively with the minimal mechanical coupling to adjacent cells, thereby facilitating efficient pumping action.

Similarly, the covering plate 24 must be hermetically sealed to the cells by an elastic medium, and the preferred elastomer may be used for this bond as well. The covering plate 24 is preferably made from a metal, most preferably copper, and outfitted with a plurality of cooling fins 30 constructed of the same material. Construction of plate 24 and fins 30 of the preferred material facilitates the conduction away and dissipation of heat generated in the gas by the compression process.

The entire assembly of cells and cover plate can be vacuum-impregnated with the elastomer by methods well-known in the elastomer art. The integrity of the channel 26 can be preserved during this process, for example, by preinserting a solid rod into the channel space, vacuum impregnating, and then removing the rod. An appropriate release agent applied to the surface of the rod would facilitate its removal.

As will be explained in greater detail below, the channel diameter is preferably on the order of millimeters, even for cells containing relatively high-pressure gas. By providing such a relatively wide channel diameter, pressure drops arising from viscous drag are minimized. The compressor is self-valving, since the elastomer is electrostrictively extruded into a closing relationship with the channel 26 defined in covering plate 24. So long as this closing relationship results in elastomer-channel interfaces on the order of microns, the channel section is effectively valved.

As an alternative embodiment, it will be recognized that each cell of compressor 10 may be constructed with a single block of the electrostrictive material disposed adjacent the elastomer-filled gap 20. In such a case, a rigid side wall would be provided for gap 20 opposite the block, and the elastomer would be extruded by the block compressing it against the rigid wall.

Figure 8:
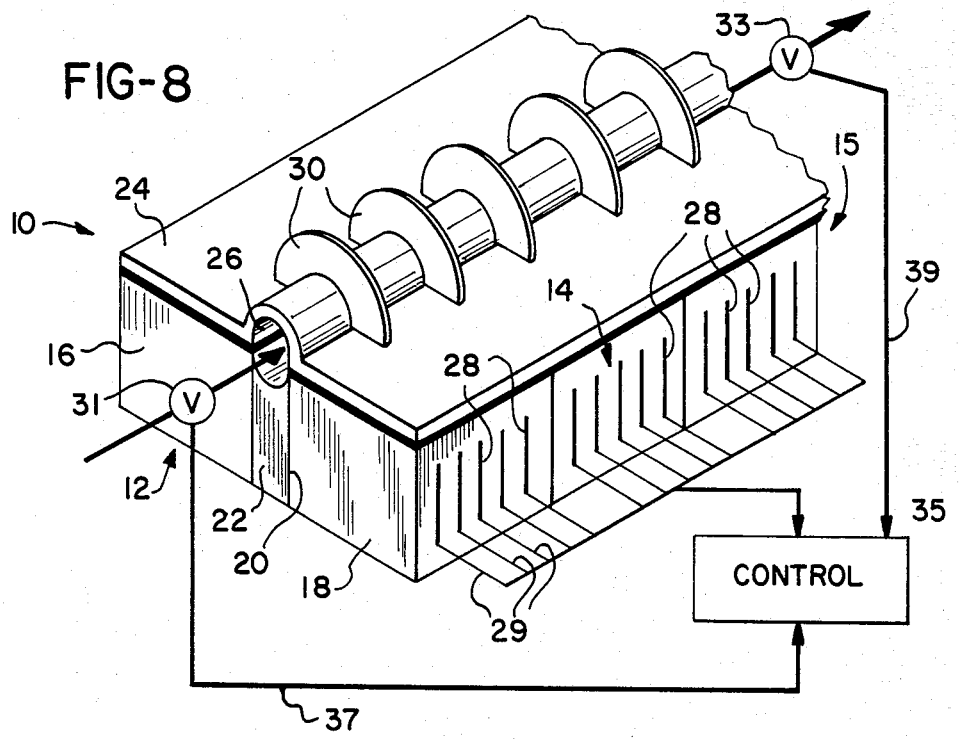
FIG. 8 is a perspective schematic view showing a three-cell gas compressor according to the present invention with inlet and outlet valves and an electric field control device.

An exemplary three-cell compressor with inlet and outlet valves is illustrated in FIG. 8, with like elements being referred to by like reference numerals. As shown in FIG. 8, compressor 10 has individual cells 12, 14, and 15, respectively, with each cell including a pair of blocks of the ceramic material 16 and 18. The operation of the device is controlled by an electrical control device 35 whose structural and operational characteristics are, per se, known. Control device 35 selectively and sequentially causes the application of an electric field to electrodes 28 through electrical leads 29. For simplicity, the set of electrodes 28 which are connected to ground have not been shown in FIG. 8. Electrical control device 35 also operates the opening and closing of inlet valve 31 and outlet valve 33, respectively, through electrical leads 37 and 39. Valves 31 and 33 may themselves be electrostrictive or piezoelectric devices, or may be external electromechanical valves.

The operation of a gas compressor constructed according to the present invention, consisting for purposes of example of ten cells similar to those in shown in FIG. 2 as cells 12 and 14, is described as follows. It will be seen that in the exemplary ten-cell compressor, the first cell and the tenth cell operate effectively as an inlet valve and an outlet valve, respectively. It will be understood that references to closing and opening of the various cells refers to the extrusion and release of the elastomer of the various cells into and out of the respective channels. The extrusion is, of course, performed in response to the application of an electric field to the various ceramic blocks.

Initially, the tenth cell is closed, while all other cells are opened, and a low pressure gas is directed into and allowed to fill the entire passageway defined by the various sequentially connected channels. The first cell is then closed, thereby retaining a quantity of gas within the passageway. The second cell is next closed, followed by the third, the fourth, and so on, until all the gas is compressed into the ninth cell. Finally, the tenth cell is opened simultaneously with the closing of the ninth cell, and the compressed gas is exhausted.

One variation on this process is to open the first cell, second, and so forth as the gas is compressed into the subsequent cells, so as to reduce the overall cycle time of the compressor. Additionally, it is advantageous to arrange the sequential addressing of the cells such that the closure of the higher-pressure cells takes place more slowly than the closure of the lower pressure cells so as to dissipate the heat of compression uniformly along the entire passageway.

The utility of the peristaltic gas compressor of the present invention may be illustrated by considering a realistic model as an example of the preferred embodiment. While this model is an approximation in the fine details, it gives a reliable estimation of the major features of the invention.

Figure 3:
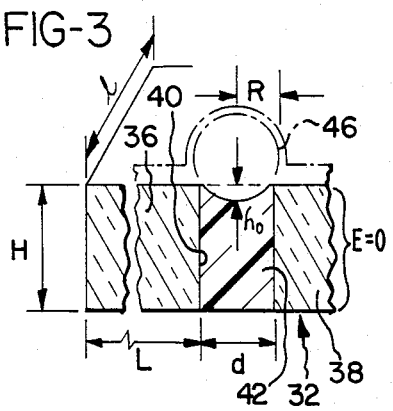
FIG. 3 is a partial end view of a single cell of the gas compressor to which no electric field is applied with elastomer motion again exaggerated.
Figure 3A:
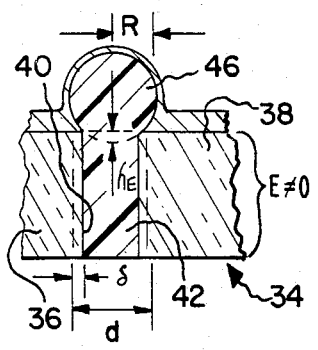
FIG. 3*a* is a partial end view of a single cell identical to that shown in FIG. 3, to which an electric field is applied with elastomer motion again exaggerated.

Referring now to FIGS. 3 and 3*a*, partial end views of two identical cells 32 and 34 are shown, with cell 32 illustrated in an open condition (E=O, no electric field applied), and cell 34 illustrated in a closed condition (E≠O, electric field applied). Each cell includes a pair of ceramic blocks 36 and 38, each being of a length L, a thickness l, and a heighth H. A gap 40 formed between blocks 36 and 38 has an "open" gap width d, and a "closed" gap d-2δ. The channel 46 for each of cells 32 and 34 has a radius R, with R greater than d/2, such that the circle defined by channel 46 extends into the gap 40 an amount $h_o$ in the open state, and $h_E$ in the closed state. The radius R is a close approximation of the actual radii $R_o$ and $R_E$, respectively, and will be used throughout the specification. The elastomer 42 of the open cell 32 is formed within gap 40 such that its upper surface coincides with the circle defined by channel 46. In the closed cell 34, it can be seen that the substantially uniform displacement of blocks 36 and 38 extrudes elastomer 42 so as to completely fill channel 46. While channel 46 in this example has been illustrated as cylindrical for convenience, it will be appreciated that other channel shapes may be chosen to minimize the total deformation required of the elastomer which may be advantageous in reducing fatigue and extending pump life.

The geometric relations for the cells as shown in FIGS. 3 and 3*a* are:

$$d = 2R\sqrt{2X_o - X_o^2} \tag{7}$$

$$d - 2\delta = 2R\sqrt{2X_E - X_E^2} \tag{8}$$

$$2H\,\delta/R^2 = \pi + \cos^{-1}(1 - X_o) - \cos^{-1}(1 - X_E) + (1 - X_E)\sqrt{2X_E - X_E^2} - (1 - X_o)\sqrt{2X_o - X_o^2}\,, \tag{9}$$

where $$X_o = h_o/R; \tag{10}$$

$$X_E = h_E/R; \tag{11}$$

Eq. (9) shows that the height H is an important amplification variable, since $R^2 \propto H$. The displacement δ is related to L from Eq. (5):

$$\delta = L\epsilon_o 2\epsilon 2(E)Q_{12}E^2 \tag{12}$$

A ten cell compressor, wherein the first and tenth cells are the inlet and outlet valves, respectively, such as that described above, is once again considered. Reasonable values for several of the parameters shown in FIGS. 3 and 3*a* common to all ten cells are adopted such that L=10 cm, d=1 mm, and $\delta = 7\times10^{-3}$ cm. This displacement δ corresponds to a strain value of $7\times10^{-4}$ which represents a middle value of the range of realizable electrostrictive strains for the materials described above. Finally, the radius of the channel of the second cell is selected such that $R_2$=1 mm.

The compression ratio for the gas compressor is selected to be 25:1. Since this compression is performed by effectively reducing the gas volume, the ideal gas relationship under isothermal conditions may be considered:

$$PV = \text{constant}. \tag{13}$$

The volume of the $j^{th}$ cell channel, from FIG. 3, is $\pi R_j^2 l_j$, and for the 25:1 compression ratio $$P_9/P_2 = 25 = \sum_{j=2}^{9} R_j^2 l_j / R_9^2 l_9 \tag{14}$$

where $P_2$ is the initial pressure when the gas to be compressed occupies the second through the ninth cells.

A "telescoping" configuration is provided to the compressor passageway by providing that:

$$R_{j+1}^2 = kR^2 j \tag{15}$$

$$l_{j+1} = Cl_j \tag{16}$$

where $k<1$ and $c<1$. Arbitrarily selecting $l_9$ such that $l_9=\frac{1}{2}l_2$, the solutions to Eqs. (14) through (16) are $$c=0.906 \quad (17)$$

$$k=0.917 \quad (18)$$

for the "telescoping" parameters.

It will be recognized that there is a significant amount of arbitrariness in arriving at the parameters given in Eqs. (17) and (18), and other values may be selected to satisfy the desired compression ratio. The selected parameters, however, do impart an equivalency to the attenuations of R and l, in that $R_9/R_2=54.6\%$ and $l_9/l_2=50\%$. If the cell thicknesses were to remain constant, for example, then $R_9/R_2=38.6\%$. It is desirable, however, to maintain the attenuations ratios and the channel diameter of the final cell as large as possible in order to minimize viscous drag pressure drops.

The remainder of the model solution may now be solved in a straightforward fashion. For the $j^{th}$ cell, Eqs. (15) and (17) are solved for $R_j$, Eqs. (7) and (8) are solved for $X_o$ and $X_E$ and Eq. (9) is solved for $H_j$. Finally, setting the passageway length from the second through ninth cell equal to 10 cm allows the determination of the $l_j$ from Eqs. (16) and (18).

Figure 4:
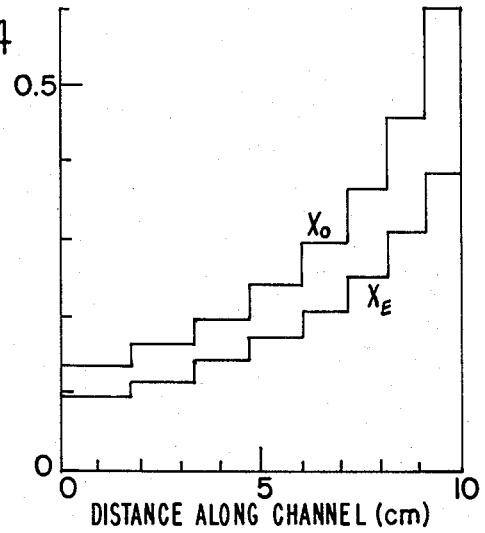
FIG. 4 is a plot showing the variation of the ratios $X_0$ and $X_E$ as a function of distance along a channel having certain exemplary dimensions.
Figure 5:
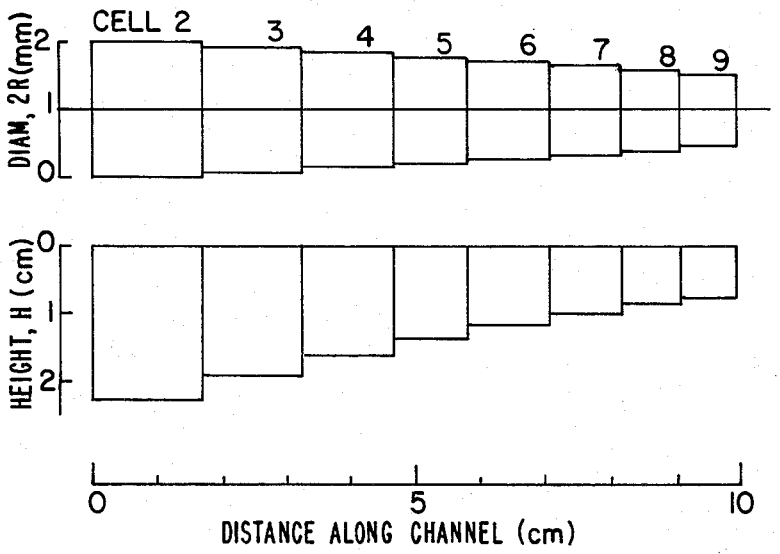
FIG. 5 is a schematic representation showing the configuration of the passageway of the gas compressor constructed according to the exemplary dimensions.

The solutions for this model are illustrated in FIGS. 4 and 5. FIG. 4 shows the stepwise variation of $X_o$ and $X_E$ along the passageway, and FIG. 5 shows' scale drawings of the various values of $R_j$, $H_j$, and $l_j$. The $X_o$ and $X_E$ data of FIG. 4 illustrate that the channel circle in each successive cell gradually extends further into the gap between the blocks (the gap diameter of 1 mm being uniform for all cells), but the channel circle does not in any cell fit the gap, i.e., $X_o=1$. The telescoping feature of the cells and the cell channels is seen from FIG. 5, where it may be seen that the heights $H_j$ attenuate as well.

It can be seen from Eqs. (9) and (12), that $$H\delta \propto HLE^2$$

and thus in the alternative, an attenuation of L or $E^2$, or both, may be substituted for the attentuation of H.

Compression of the gas from the eighth into the ninth cell involves the largest pressure drop, and an estimate of the pressure drop due to turbulent flow in this process is approximately 0.16 atm. Similarly, the inertial pressure drop required to accelerate the gas from the eighth to ninth cell may be estimated to be approximately 1.1 atm, assuming that this process takes place in approximately $10^{-4}$ sec (i.e., a 1 kHz cycle). These values are quite acceptable in view of the 25 atm outlet pressure of the gas leaving the compressor. Additionally, the work done in accelerating the gas is smallest in closing the second cell, and largest in closing the eighth cell. These inertial work terms are dissipated as heat, and an estimate may be made showing that the work terms in closing the second and eighth cells would be equivalent if the eighth cell closed approximately $3\frac{1}{2}$ times slower than the second cell. Thus, the electronic addressing of the electric fields supplied to the cells can be staged such that the inertial work heating is uniform along the entire passageway, and the gas compression is nearly isothermal.

The elastomer is accelerated into and out of the channel at each cell, and this acceleration stresses the elastomer. Assuming times on the order of $10^{-4}$ sec for these accelerations, the tension between the elastomer and the ceramic member may be estimated to be approximately 1.2 psi. This represents a very modest value in comparison to the tensile strength of typical elastomers which, for example, in the case of the preferred Dow Corning Silastic TR-55, is 1450 psi.

Finally, the mass flow rates through the examplary model compressor may be estimated for various gases. From Eqs. (15) through (18), the total volume of the channels of the second through the ninth cells is 0.202 $cm^3$ and this value represents the volume of gas compressed per cycle. Assuming that the gas in the channels is initially at STP and that the compressor operates at 1 kHz, the mass flow rate is 2.02 $\rho$, where $\rho$ is the STP gas density. Table I summarizes P and mass flow rate data for several gases.

TABLE I

| Gas | Density (STP) $mg/cm^3$ | Mass Flow Rate mg/sec |
|---|---|---|
| Air | 1.293 | 261 |
| Argon | 1.784 | 360 |
| $CO_2$ | 1.977 | 399 |
| Freon* | 5.391 | 1087 |
| Freon** | 3.932 | 794 |
| Ammonia | 0.771 | 155 |
| Helium | 0.178 | 36 |
| Hydrogen | 0.0899 | 18 |
| Oxygen | 1.429 | 288 |
| Neon | 0.900 | 182 |
| Nitrogen | 1.251 | 252 |

*$CCl_2F_2$
**$CF_4$

The flow rates given in Table I for the model compressor are attractively large not only for driving the microminiature Joule-Thompson refrigerators for cryoelectronic devices, but also for applications near ambient temperatures. It will be recognized that the mass flow rates given in Table I are dependant upon the drive frequency; e.g., at 2 kHz, the flow rates are double.

The dimensions set forth in discussing the model compressor are intended to be exemplary of the preferred embodiment, and other values may be selected. While the particular dimensions have been assigned somewhat arbitrarily, it will nonetheless be recognized that all parameter and operating values selected above are comfortably within the known capabilities of the electrostrictive ceramic, multilayer tape-casting, and vacuum impregnation technologies.

Figure 6:
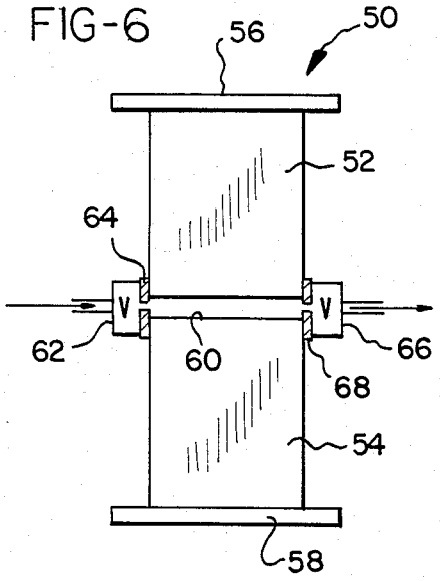
FIG. 6 is an alternative embodiment for a gas compressor of the present invention.

An alternative embodiment of the present invention is shown in FIG. 6. The compressor 50 includes a pair of ceramic blocks 52 and 54, constrained by frame members 56 and 58 such that a gap 60 is formed between blocks 52 and 54. Top and bottom covering plates (not shown) are provided such that gap 60 is hermetically sealed. A plurality of parallel metallic plate conductors (not shown) are interspersed within ceramic blocks 52 and 54, such that an electric field may be applied to blocks 52 and 54. An inlet valve 62 is connected to one end of gap 60, through sealing members 64. Similarly, an outlet valve 66 is connected to the opposite end of gap 60, through sealing members 68. Inlet valve 62 is opened, allowing a low pressure gas to enter gap 60, whereupon inlet valve 62 is closed. The electric field is applied to blocks 52 and 54, which compress the gas until the gap is almost closed. Outlet valve 66 is then opened, and the compressed gas is exhausted from gap 60. The sealing members 64 and 68, which may be formed of an elastomer material, confine the gas during compression. Valves 62 and 66 may be themselves electrostrictive or piezoelectric devices, and may form integral parts of compressor 50, or may be external mechanical valves such as self-activated reed valves.

Figure 7:
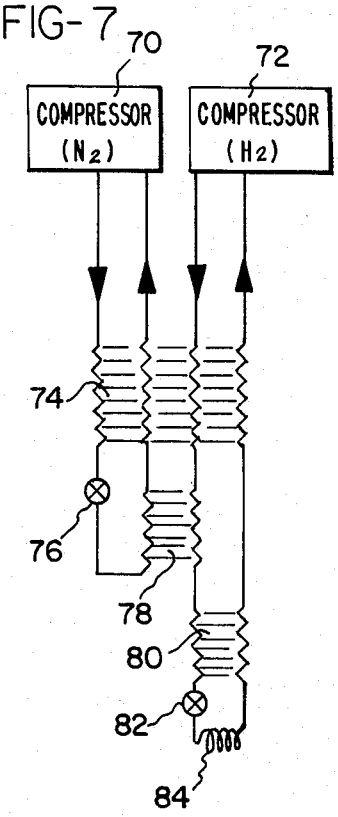
FIG. 7 is a schematic diagram illustrating the use of the gas compressor in conjunction with a two-stage Joule-Thompson refrigerator system.

The electrostrictive or piezoelectric compressors of the present invention can be integrated with Joule-Thompson ("J-T") refrigeration schemes in a manner, for example, such as that illustrated by the two-stage scheme in FIG. 7. An electrostrictive or piezoelectric compressor 70 delivers high pressure (on the order of 25 atm), nitrogen gas, and a second compressor 72 delivers high pressure, on the order of 25 atm, hydrogen gas. The pressurized nitrogen stream exhausting from compressor 70 is precooled in a four-stream heat exchanger 74 and is then expanded to a low pressure, such as 1 atm, through a J-T valve 76, by which is cooled to 77° K. The pressurized hydrogen steam exhausting from compressor 72 is also precooled in heat exchanger 74, and is further cooled to near 77° K. in heat exchanger 78, wherein the nitrogen at 77° K. absorbs heat from the hydrogen stream. The returning nitrogen stream is warmed in heat exchanger 74 before entering compressor 70 at low pressure.

The cooled, high pressure hydrogen gas is further cooled in heat exchanger 80 before undergoing an expansion in J-T valve 82 to a low pressure such as 1 atm, whereby it is cooled to a low temperature of approximately 20.2° K. Finally, the hydrogen absorbs heat from a load at heat exchanger 84. It is then warmed in heat exchangers 80 and 74 following which it enters compressor 72 at a low pressure.

Using the model example of the preferred embodiment of a gas compressor, the Table I data can be used to estimate the refrigeration capacity for a J-T scheme such as is illustrated in FIG. 7. Standard enthalpy tables are used for these estimates, and the results are summarized in Table II for a system utilizing ideal J-T expanders, 1 kHz compressor operation, and 25 atm compressions.

TABLE II

| Gas | Precool Temp °K. | Load Temp. °K. | Refrigeration (Watts) |
|---|---|---|---|
| Freon* | 300 | 243 | 158 |
| Freon** | 300 | 145 | 8.96 |
| Nitrogen | 300 | 77 | 1.31 |
| Nitrogen | 145 | 77 | 5.90 |
| Hydrogen | 77 | 20 | 1.08 |
| Helium | 20 | 4.6 | 0.367 |

*$CCl_2F_2$
**$CF_4$

The ideal compression power for all of the gases in Table II is about 72 watts. Thus, for example, a three-tier scheme of J-T expanders operating with nitrogen, hydrogen, and helium would provide 367 milliwatts of cooling at about 4.6° K.

While the methods herein described, and the forms of apparatus for carrying these methods into effect, constitute preferred embodiments of this invention, it is to be understood that the invention is not limited to these precise methods and forms of apparatus, and that changes may be made in either without departing from the scope of the invention, which is defined in the appended claims.

What is claimed is:

1. An apparatus for compressing a gas, comprising:

a block of electrostrictive or piezoelectric ceramic material having a first end;

an elastomer disposed along said first end of said block;

means defining a channel having said elastomer as at least one wall thereof;

means for selectively applying an electric field to said block; and means constraining said block such that application of said electric field to said block causes displacement thereof against said elastomer, extruding said elastomer into a closed relationship with said channel defining means.

2. An apparatus for compressing a gas, comprising:

a pair of blocks of an electrostrictive or piezoelectric ceramic material disposed in an opposing relationship and defining a gap therebetween;

an elastomer disposed within and at least partially filling said gap;

means defining a channel having said elastomer as at least one wall thereof;

means for selectively applying an electric field to said blocks; and means constraining said block such that application of said electric field of said blocks causes the displacement thereof against said elastomer, extruding said elastomer into a closed relationship with said channel defining means.

3. The apparatus of claim 2 wherein said electrostrictive ceramic material is $PbMO_3$, M being a member selected from the group consisting of Zr,Ti,$(Mg_{\frac{1}{3}}Nb_{\frac{2}{3}})$, $(Sc_{\frac{1}{3}}Ta_{\frac{2}{3}})$, and combinations thereof.

4. The apparatus of claim 2, further comprising inlet valve means for selectively introducing a quantity of gas to said channel, and outlet valve means for selectively allowing said gas to exit said channel.

5. The apparatus of claim 2, wherein said means for applying said electric field includes a plurality of metallic plates disposed in a substantially parallel, spaced relationship within each of said blocks.

6. The apparatus of claim 2, wherein said channel defining means includes a plate covering one side each of both of said blocks, said plate having a recess defined therein cooperating with said gap to form said channel.

7. An apparatus for compressing a gas, comprising:

a plurality of cells, each said cell including:

a pair of blocks of an electrostrictive or piezoelectric ceramic material disposed in an opposing relationship so as to define a gap therebetween, an elastomer disposed within and at least partially filling said gap, means defining a channel having said elastomer as at least one wall thereof, means for applying an electric field to said blocks, and means constraining said blocks such that application of said electric field to said blocks causes displacement thereof against said elastomer, extruding said elastomer into a closed relationship with said channel defining means;

said cells being arranged sequentially, such that each said channel of each said cell communicates with said channel of an immediately succeeding one of said cells; and means selectively controlling said electric field application means of each said cell for sequential closings of each of said channels.

8. The apparatus of claim 7, wherein said electrostrictive ceramic material is $PbMO_3$, M being a member selected from the group consisting of Zr, Ti, $(Mg_{\frac{1}{3}}Nb_{\frac{2}{3}})$, $(Sc_{\frac{1}{3}}Ta_{\frac{2}{3}})$, and combinations thereof.

9. The apparatus of claim 7, further comprising inlet valve means disposed in operative relationship with said channel of the first of said sequential cells, for selectively introducing a quantity of gas to said channels, and outlet valve means disposed in operative relationship with said channel of the last of said sequential cells, for selectively allowing said gas to exit said channels.

10. The apparatus of claim 9, wherein said inlet valve means includes another of said cells, said channel of said inlet valve cell communicating with said channel of said first sequential cell, and said outlet valve means includes another of said cells, said channel of said outlet valve cell communicating with said channel of said last sequential cell, said electric field control means being further adapted to control selectively said electric field application means of said inlet valve cell and said outlet valve cell.

11. The apparatus of claim 7, wherein said means for applying said electric field includes a plurality of metallic plates disposed in a substantially parallel, spaced relationship, within each of said blocks.

12. The apparatus of claim 7, wherein the volume defined by each said channel of each said sequential cell is smaller than the volume defined by said channel of the immediately preceding one of said cells.

13. An apparatus for compressing a gas, comprising:

a block of an electrostrictive or piezoelectric ceramic material;

means defining a channel having said block as at least one wall thereof, said channel having a first and second end;

inlet valve means for selectively introducing a quantity of gas to said channel at said first end;

outlet valve means for selectively exhausting said gas from said channel at said second end;

means for selectively applying an electric field to said block which includes a plurality of metallic plates disposed in a substantially parallel, spaced relationship within said block; and means constraining said block such that application of said electric field to said block causes substantially uniform displacement thereof so as to narrow said channel, thereby compressing said gas.

14. An apparatus for compressing a gas, comprising:

a pair of blocks of an electrostrictive or piezoelectric ceramic material disposed in opposing relationship and defining a gap therebetween;

means defining a channel coincident with said gap;

inlet valve means for selectively introducing a quantity of gas to said channel;

outlet valve means for selectively exhausting said gas from said channel;

means for selectively applying an electric field to said blocks which includes a plurality of metallic plates disposed in a substantially parallel, spaced relationship within each of said blocks; and means constraining said blocks such that application of said electric field to said blocks causes substantially uniform displacement thereof so as to narrow said channel, thereby compressing said gas.

15. An apparatus for pumping a fluid comprising:

a block of an electrostrictive or piezoelectric ceramic material;

means defining a channel having said block as at least one wall thereof, said channel having a first and second end;

inlet valve means for selectively introducing a quantity of fluid to said channel at said first end;

outlet valve means for selectively exhausting said fluid from said channel at said second end;

means for selectively applying an electric field to said block which includes a plurality of metallic plates disposed in a substantially parallel, spaced relationship within said block; and means constraining said block such that application of said electric field to said block causes substantially uniform displacement thereof so as to narrow said channel, thereby pumping said fluid.

16. An apparatus for pumping a fluid comprising:

a block of an electrostrictive or piezoelectric ceramic material having a first end;

an elastomer disposed along said first end of said block;

means defining a channel having said elastomer as at least one wall thereof, said channel having a first and second end;

inlet valve means for selectively introducing a quantity of fluid to said channel at said first end;

outlet valve means for selectively exhausting said fluid from said channel at said second end;

means for selectively applying an electric field to said block; and means constraining said block such that application of said electric field to said block causes substantially uniform displacement thereof against said elastomer, extruding said elastomer into a closed relationship with said channel defining means, thereby pumping said fluid.

* * * * *